US008837994B2

(12) United States Patent
Kuroki et al.

(10) Patent No.: US 8,837,994 B2
(45) Date of Patent: Sep. 16, 2014

(54) METHOD FOR CONTROLLING IMAGE FORMING APPARATUS, AND IMAGE FORMING APPARATUS

(75) Inventors: Kenji Kuroki, Toride (JP); Hiroto Nishihara, Toride (JP); Hiroyuki Eda, Moriya (JP); Hideyuki Ikegami, Abiko (JP); Tsuyoshi Shiga, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 13/327,629

(22) Filed: Dec. 15, 2011

(65) Prior Publication Data

US 2012/0163880 A1 Jun. 28, 2012

(30) Foreign Application Priority Data

Dec. 22, 2010 (JP) ..... 2010-286522

(51) Int. Cl.
*G03G 15/00* (2006.01)

(52) U.S. Cl.
CPC .... *G03G 15/5058* (2013.01); *G03G 2215/0129* (2013.01); *G03G 2215/0161* (2013.01)
USPC ..... 399/301

(58) Field of Classification Search
CPC ..... G03G 15/01
USPC ..... 399/301, 72
See application file for complete search history.

(56) References Cited

U.S. PATENT DOCUMENTS

| | | | | | |
|---|---|---|---|---|---|
| 5,576,753 | A * | 11/1996 | Kataoka et al. | ..... | 347/248 |
| 5,828,925 | A * | 10/1998 | Yoshizawa | ..... | 399/39 |
| 6,701,117 | B2 * | 3/2004 | Kaji | ..... | 399/301 |
| 7,139,518 | B2 * | 11/2006 | Masubuchi | ..... | 399/301 |
| 8,185,005 | B2 * | 5/2012 | Murayama | ..... | 399/49 |
| 8,342,517 | B2 * | 1/2013 | Kinoshita et al. | ..... | 271/228 |
| 2003/0068180 | A1 * | 4/2003 | Kaji | ..... | 399/301 |
| 2008/0069602 | A1 * | 3/2008 | Miyadera | ..... | 399/301 |

FOREIGN PATENT DOCUMENTS

| | | | | |
|---|---|---|---|---|
| JP | 2003-098795 | * | 4/2003 | ..... G03G 15/00 |
| JP | 2003-098795 | A | 4/2003 | |

* cited by examiner

*Primary Examiner* — Clayton E Laballe
*Assistant Examiner* — Kevin Butler
(74) *Attorney, Agent, or Firm* — Canon U.S.A., Inc. IP Division

(57) ABSTRACT

If any of a plurality of conditions is satisfied, an image forming apparatus having a plurality of image forming units that form images on an intermediate transfer member in a superimposed manner detects, using a pattern detection sensor, the amount of color misregistration of the images formed by the plurality of image forming units on the intermediate transfer member and corrects the color misregistration of the images formed by the plurality of image forming units in accordance with the amount of color misregistration that is smaller than a color misregistration correction tolerance, which varies depending on the plurality of conditions, and that has been detected by the pattern detection sensor.

7 Claims, 7 Drawing Sheets

FIG. 7

[Pixel]

| | COLOR MISREGISTRATION CORRECTION FACTOR | MAIN SCANNING CORRECTION TOLERANCE | SUB-SCANNING CORRECTION TOLERANCE | MAGNIFICATION CORRECTION TOLERANCE | INCLINATION CORRECTION TOLERANCE |
|---|---|---|---|---|---|
| 701 | CERTAIN NUMBER OF PRINTS EXCEEDED | 15 | 20 | 20 | 15 |
| 702 | CERTAIN TIME ELAPSED | 15 | 20 | 20 | 15 |
| 703 | LARGE CHANGE IN TEMPERATURE | 30 | 30 | 50 | 20 |
| 704 | LASER SCANNER UNIT REPLACEMENT | 80 | 80 | 70 | 100 |
| 705 | DRUM CARTRIDGE REPLACEMENT | 60 | 80 | 60 | 100 |
| 706 | INTERMEDIATE TRANSFER MEMBER UNIT MOUNTING/REMOVAL | 60 | 40 | 40 | 50 |

METHOD FOR CONTROLLING IMAGE FORMING APPARATUS, AND IMAGE FORMING APPARATUS

CROSS-REFERENCE TO RELATED APPLICATIONS

This application claims the benefit of Japanese Patent Application No. 2010-286522, which was filed Dec. 22, 2010, and which is hereby incorporated by reference herein in its entirety.

BACKGROUND OF THE INVENTION

1. Field of the Invention

The present invention relates to an image forming apparatus that corrects positional deviations of images formed by a plurality of image forming units.

2. Description of the Related Art

Currently, an electrophotographic image forming apparatus that forms multicolor images forms the multicolor images by superimposing images in a plurality of colors, and therefore needs to correct positional deviations between the images in the plurality of colors, that is, needs to correct color misregistration. A method is known in which color misregistration amount detection patterns are formed on an intermediate transfer belt and the amount of color misregistration is detected by reading the color misregistration amount detection patterns using an optical sensor, and then the color misregistration is corrected by correcting the image forming timing for each color (Japanese Patent Laid-Open No. 2003-098795). If the speed of the intermediate transfer belt or the like has changed due to a disturbance while the color misregistration amount detection patterns are being formed or read and an amount of color misregistration larger than the actual amount has been incorrectly detected, incorrect color misregistration correction is undesirably performed. In order to prevent the incorrect color misregistration correction, a method has been proposed in which, if an amount of color misregistration larger than a certain amount has been detected, color misregistration correction based on this amount is not performed.

However, in the case of the configuration with which an amount of color misregistration larger than the certain amount is always ignored, color misregistration correction cannot be performed even when color misregistration whose amount actually exceeds the certain amount is caused. For example, when the position of a unit in the image forming apparatus has changed due to replacement of the unit, a large amount of color misregistration can be caused.

SUMMARY OF THE INVENTION

The present invention provides a method for controlling an image forming apparatus including the steps of transferring images in several colors formed by a plurality of image forming units onto an image bearing member, detecting an amount of positional deviation of the images formed by the plurality of image forming units on the image bearing member, and correcting the positional deviation of the images formed by the plurality of image forming units in accordance with the amount of positional deviation detected, wherein the correction of the positional deviation is not performed if the amount of positional deviation is larger than a tolerance corresponding to a condition.

Further features of the present invention will become apparent from the following description of exemplary embodiments with reference to the attached drawings.

BRIEF DESCRIPTION OF THE DRAWINGS

FIG. 7 is a diagram illustrating color misregistration correction tolerances for each color misregistration correction factor.

DESCRIPTION OF THE EMBODIMENTS

Figure 1:
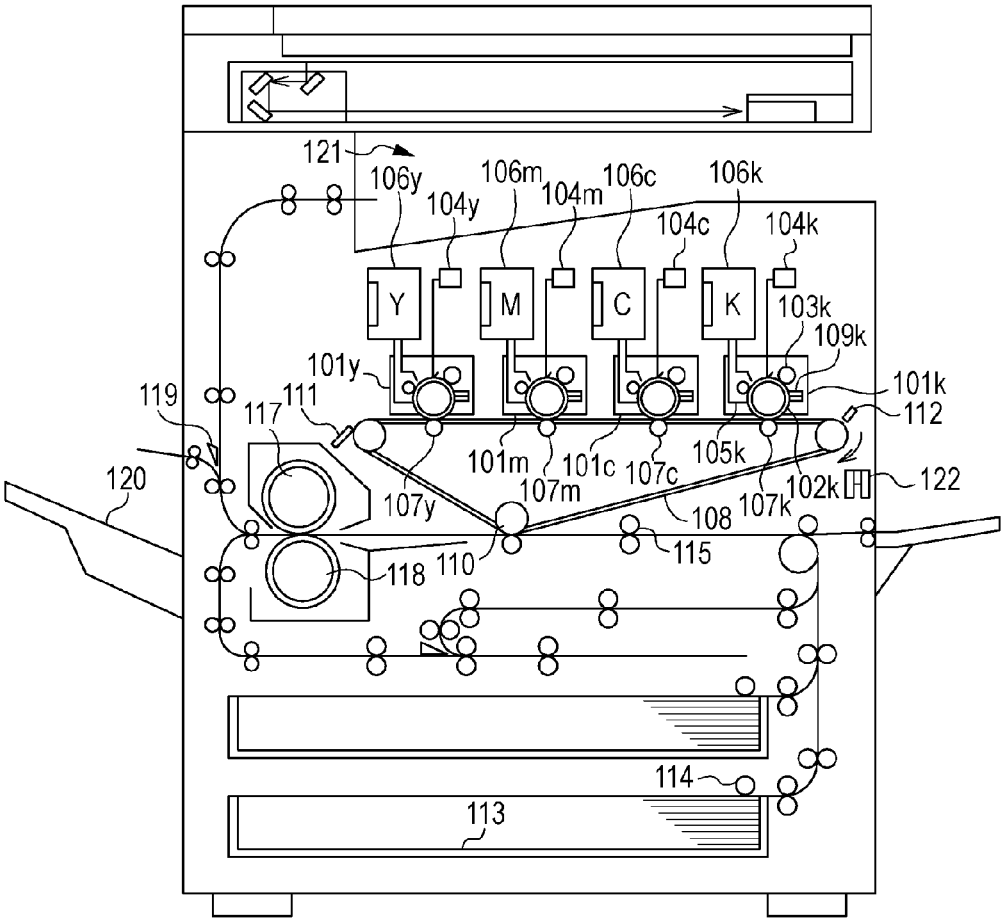
FIG. 1 is a cross-sectional view of an image forming apparatus according to an exemplary embodiment.

FIG. 1 is a cross-sectional view of an image forming apparatus according to an exemplary embodiment. Yellow (Y), magenta (M), cyan (C), and black (K) process units 101*y* to 101*k* (a plurality of image forming units) each have a photosensitive drum (photosensitive member), a developing unit, a charging roller, and the like. A photosensitive drum 102*k* in the process unit 101*k* is driven by a motor in a rotating manner. A charging roller 103*k* evenly charges a surface of the photosensitive drum 102*k* by applying high voltage to the photosensitive drum 102*k*. A laser scanner unit 104*k* emits laser light according to image data. The laser light is deflected by a polygonal mirror, which is driven in a rotating manner, and scans the photosensitive drum 102*k*. An electrostatic latent image is formed on the photosensitive drum 102*k* exposed to the laser light. A developing unit 105*k* develops the electrostatic latent image formed on the photosensitive drum 102*k* using toner. A toner bottle 106*k* filled with the toner supplies the toner to the developing unit 105*k*. A primary transfer roller 107*k* performs primary transfer in order to transfer a toner image on the photosensitive drum 102*k* onto an intermediate transfer member 108 (image bearing member), which is a member having the shape of an endless belt, and superimpose a K toner image upon Y, M, C toner images formed on the intermediate transfer member 108. An auxiliary charging brush 109*k* charges toner that has not been transferred onto the intermediate transfer member 108 and that has been left on the photosensitive drum 102*k*.

Although only the black process unit 101*k* (the photosensitive drum 102*k*, the charging roller 103*k*, the developing unit 105*k*, and the auxiliary charging brush 109*k*) has been described, the yellow, magenta, and cyan process units have the same configuration. In the following description, the term "photosensitive drums 102", "charging rollers 103", "developing units 105", or "auxiliary charging brushes 109" refers to the components included in the process units for all the colors, namely yellow, magenta, cyan, and black.

The toner image subjected to the primary transfer and transferred onto the intermediate transfer member 108 is then subjected to secondary transfer performed by a secondary transfer roller 110 and transferred onto a sheet. Toner that has not been transferred onto the sheet and that has been left on the intermediate transfer member 108 and an adjustment toner image, which is not intended to be transferred onto the sheet, are retrieved by a cleaner 111. A pattern detection sensor 112 detects a toner pattern image created on the intermediate transfer member 108.

Sheets are stored in sheet cassettes 113 and conveyed by paper feed rollers 114. Inclined sheets are corrected by a registration roller 115 and then conveyed to the secondary transfer roller 110. A toner image is transferred onto a sheet by the secondary transfer roller 110 and the toner is thermally fixed on the sheet by a fixing roller 117 and a pressing roller 118. The sheets are then conveyed to a paper output tray 120 or to an inner paper output tray 121 by a paper output flapper 119.

A door is provided on an outer surface of the image forming apparatus in order to allow the intermediate transfer member 108 to be mounted in and removed from the image forming apparatus. A transfer unit mounting/removal door open/closed detection sensor 122 is also provided in order to detect the open/closed state of the door. The transfer unit mounting/removal door open/closed detection sensor 122 includes a light-emitting diode (LED) and a photodiode. When the door is open and the intermediate transfer member 108 can be mounted and removed, light emitted from the LED is received by the photodiode. When the door is closed and images can be formed, the light emitted from the LED is blocked and not received by the photodiode. The transfer unit mounting/removal door open/closed detection sensor 122 outputs a signal according to the open/closed state of the door.

Figure 2:
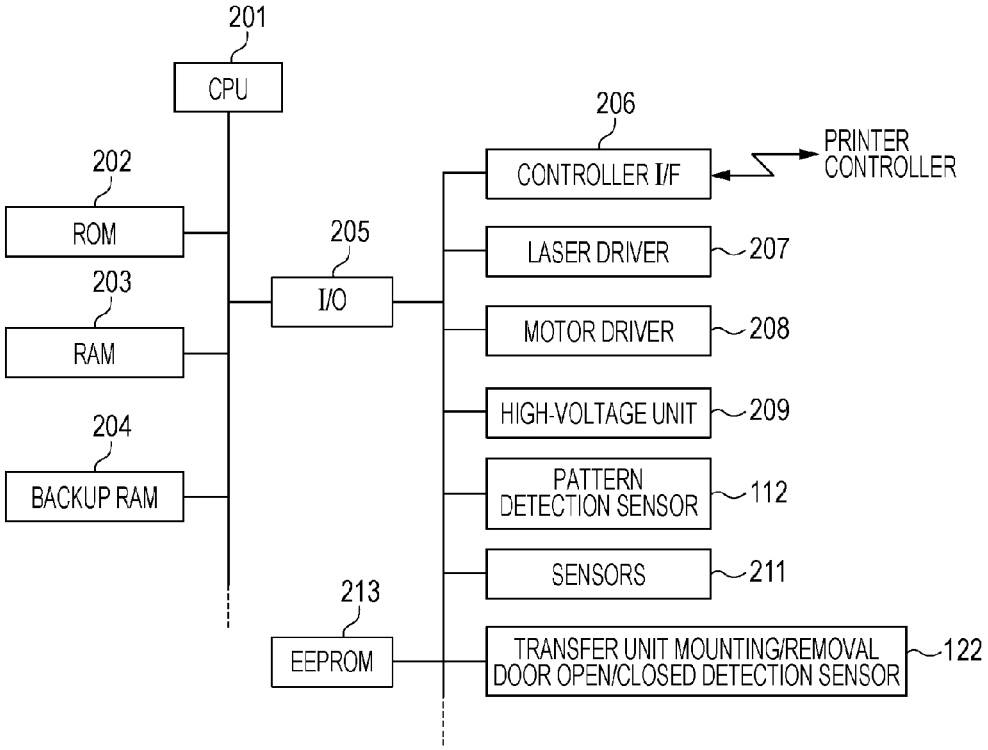
FIG. 2 is a diagram illustrating the configuration of a control block of the image forming apparatus.

FIG. 2 is a diagram illustrating the configuration of a control block of the image forming apparatus. A central processing unit (CPU) 201 controls the image forming apparatus. A read-only memory (ROM) 202 stores programs for operating the CPU 201. A random-access memory (RAM) 203 is used by the CPU 201 to temporarily store data. A backup RAM 204 makes it possible to hold information set by the image forming apparatus even if the power is turned off. A backup battery supplies power to the backup RAM 204. An input/output port 205 is an interface with a device connected to the CPU 201.

A controller interface (I/F) 206 is an interface for connecting to a printer controller that supplies an input image signal. A laser driver 207 controls laser scanner units 104*y* to 104*k*. A motor driver 208 controls motors that drive the photosensitive drums 102, the intermediate transfer member 108, the paper feed rollers 114, and the registration roller 115 in a rotating manner. A high-voltage control unit 209 controls the high-voltage outputs of the charging rollers 103 of the process units 101, the developing units 105, the primary transfer rollers 107, and the secondary transfer roller 110. The pattern detection sensor 112 is connected to the CPU 201 through the input/output port 205. Sensors 211 detect presence/absence of sheets, the conveying position of the sheets, electric potential, temperature, and the like. The transfer unit mounting/removal door open/closed detection sensor 122 is connected to the CPU 201 through the input/output port 205. The CPU 201 monitors the transfer unit mounting/removal door open/closed detection sensor 122 at 100-ms intervals and, when the door is opened, records a door open/close detection history on the backup RAM 204. An electrically erasable programmable read-only memory (EEPROM) 213 is provided in each of the laser scanner units 104 and stores a unique correction value of each of the laser scanner units 104.

Figure 3:
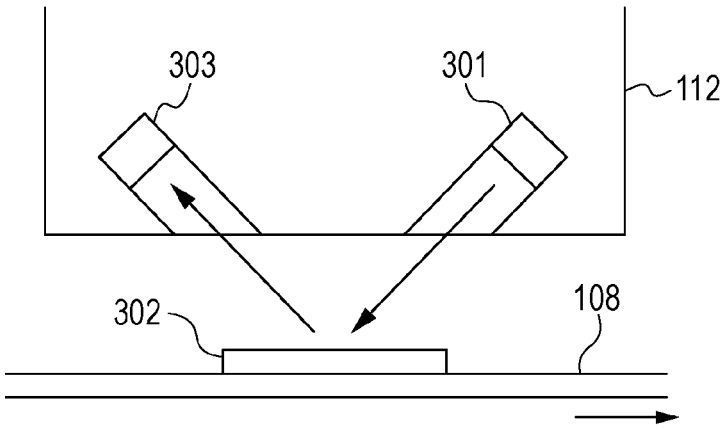
FIG. 3 is a diagram illustrating the configuration of a pattern detection sensor.

FIG. 3 is a diagram illustrating the configuration of the pattern detection sensor 112. The pattern detection sensor 112 has a light-emitting portion 301 configured by an infrared LED or the like and a photodetector 303 configured by a phototransistor or the like. The light-emitting portion 301 is provided at a position and in an orientation with which the light-emitting portion 301 diagonally emits light toward a surface of the intermediate transfer member 108. The photodetector 303 is provided at a position and in an orientation with which the photodetector 303 receives specular reflected light from the intermediate transfer member 108. Infrared light emitted from the light-emitting portion 301 is reflected by the intermediate transfer member 108 or color misregistration detection patterns 302, and specular reflected light thereof enters the photodetector 303. The color misregistration detection patterns 302 on the intermediate transfer member 108 are detected on the basis of changes in the quantity of reflected light received by the photodetector 303. The reflected light received by the photodetector 303 is converted into an electric signal according to the quantity of reflected light.

The voltage of an electric signal output from the photodetector 303 becomes lower as the quantity of reflected light becomes smaller, and higher as the quantity of reflected light becomes larger. The quantity of reflected light becomes smaller as the amount of toner on the intermediate transfer member 108 becomes larger, and larger as the amount of toner on the intermediate transfer member 108 becomes smaller. In addition, because the surface of the intermediate transfer member 108 is glossy, the quantity of reflected light is larger when there is no toner on the intermediate transfer member 108 than when there is toner on the intermediate transfer member 108. Therefore, it is judged that there is no color misregistration detection pattern 302 when the output voltage of the pattern detection sensor 112 is a certain value or more, and that there is a color misregistration detection pattern 302 when the output voltage of the pattern detection sensor 112 is less than the certain value.

Figure 4:
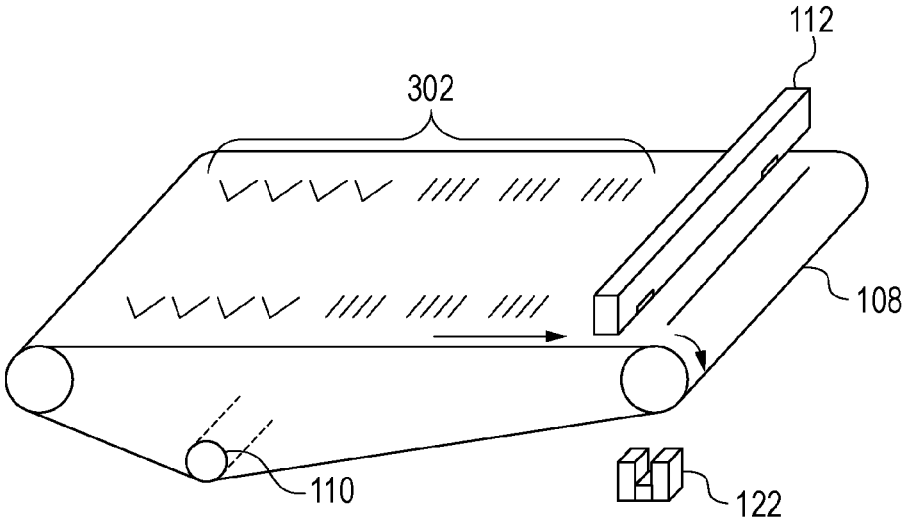
FIG. 4 is a diagram illustrating color misregistration detection patterns formed on an intermediate transfer member.

FIG. 4 is a diagram illustrating the color misregistration detection patterns 302 formed on the intermediate transfer member 108. The positional relationship between the pattern detection sensor 112, the intermediate transfer member 108, and the color misregistration detection patterns 302 is as illustrated in FIG. 4. The pattern detection sensor 112 reads a plurality of color misregistration detection patterns 302 formed on the moving intermediate transfer member 108.

Figure 5A:
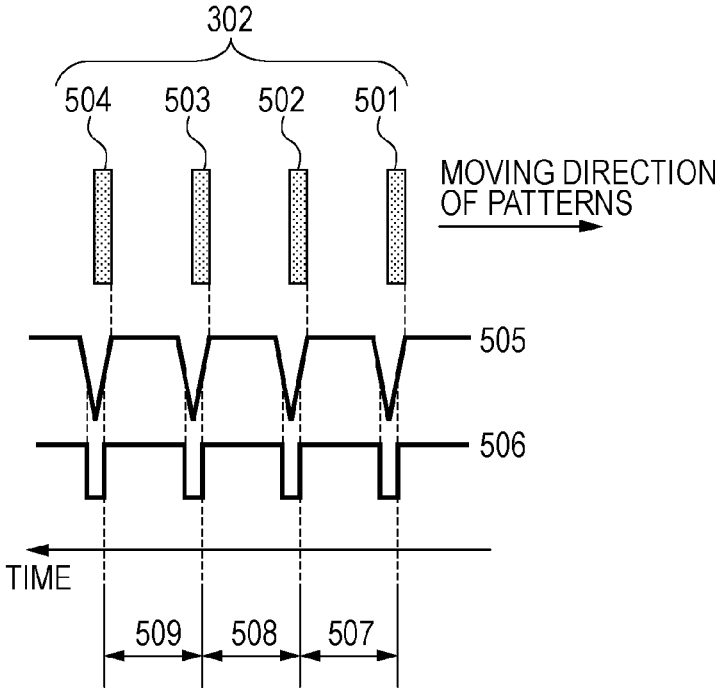
FIGS. 5A and 5B are diagrams illustrating color misregistration amount detection using the color misregistration detection patterns.
Figure 5B:
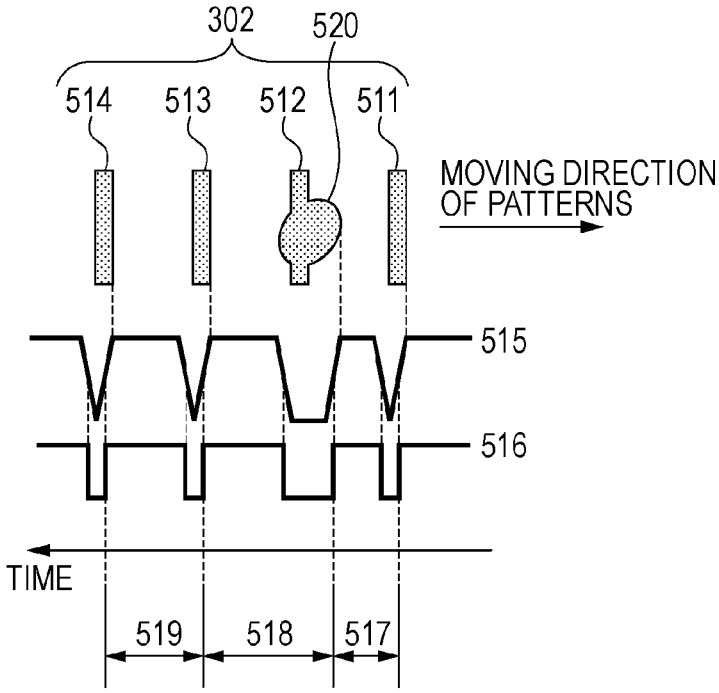

FIGS. 5A and 5B are diagrams illustrating color misregistration amount detection using the color misregistration detection patterns 302. In FIG. 5A, patterns 501 to 504 are patterns created by yellow, magenta, cyan, and black toners, respectively, and formed at intervals of 300 pixels. These patterns are formed on the intermediate transfer member 108 and then detected by the pattern detection sensor 112. Output voltage 505 of the photodetector 303 of the pattern detection sensor 112 is compared with a threshold voltage by a comparator, and an edge detection waveform 506 is obtained. The comparator outputs high level when the output voltage 505 of the photodetector 303 is the threshold value or more, and low level when the output voltage 505 of the photodetector 303 is less than the threshold value.

The CPU 201 measures, using a timer counter thereof that counts values with a built-in clock, a period of time between a falling edge and a next falling edge in the edge detection waveform 506 input through the input/output port 205. In FIG. 5A, time (counted value) 507 is a distance between yellow and magenta, time (counted value) 508 is a distance between magenta and cyan, and time (counted value) 509 is a distance between cyan and black. Since the patterns 501 to 504 are formed at intervals of 300 pixels, the counted values of the timer counter are converted into the numbers of pixels, and results obtained by subtracting 300 pixels from the numbers of pixels represent the amounts of color misregistration. The amounts of color misregistration are the amounts of positional deviation of a plurality of images formed on the image bearing member by a plurality of image forming units. The CPU 201 corrects color misregistration by changing, in a direction opposite the direction of the color misregistration, the timing at which images are begun to be drawn in accordance with the amounts of color misregistration.

FIG. 5B is a diagram illustrating detection of color misregistration when there is a defect on the intermediate transfer member 108. In FIG. 5B, patterns 511 to 514 are patterns created by yellow, magenta, cyan, and black toner, respectively, and formed at intervals of 300 pixels. FIG. 5B illustrates an example in which the magenta pattern 512 has been undesirably formed on a defect 520 on the intermediate transfer member 108.

The pattern detection sensor 112 at this time incorrectly detects the defect 520 as the magenta pattern 512. Output voltage 515 of the photodetector 303 decreases before the magenta pattern 512 reaches the pattern detection sensor 112 because of a decrease in the quantity of reflected light caused by the defect 520. Therefore, only a falling edge corresponding to the magenta pattern 512 appears earlier than it would otherwise be among falling edges of an edge detection waveform 516 output from the comparator. As a result, whereas a distance between cyan and black, which represents time (counted value) 519, indicates the actual distance, a distance between yellow and magenta, which represents time (counted value) 517, and a distance between magenta and cyan, which represents time (counted value) 518, undesirably indicate distances different from the actual distances. In this case, if correction according to results of the detection of color misregistration is performed, the color misregistration becomes worse.

As described above, an abnormally large distance between color misregistration detection patterns may be detected due to a defect on the intermediate transfer member 108. Such a phenomenon in which an abnormally large distance between color misregistration detection patterns is detected can also be caused when the moving speed of the intermediate transfer member 108 momentarily decreases due to a slip of a drive roller of the intermediate transfer member 108. Therefore, the CPU 201 ignores results of detection of color misregistration and does not perform color misregistration correction when a distance between color misregistration detection patterns is abnormally large, that is, when a distance between color misregistration detection patterns exceeds a color misregistration correction tolerance.

However, if the same color misregistration correction tolerance is constantly used in every situation, color misregistration correction cannot be performed when a large amount of color misregistration is actually caused, not due to incorrect detection. For example, a large amount of color misregistration can be caused when the position of a unit can change due to replacement of the unit in the image forming apparatus. Therefore, in this embodiment, color misregistration correction tolerances according to color misregistration correction factors, which are conditions under which color misregistration correction is begun, are used.

Figure 6:
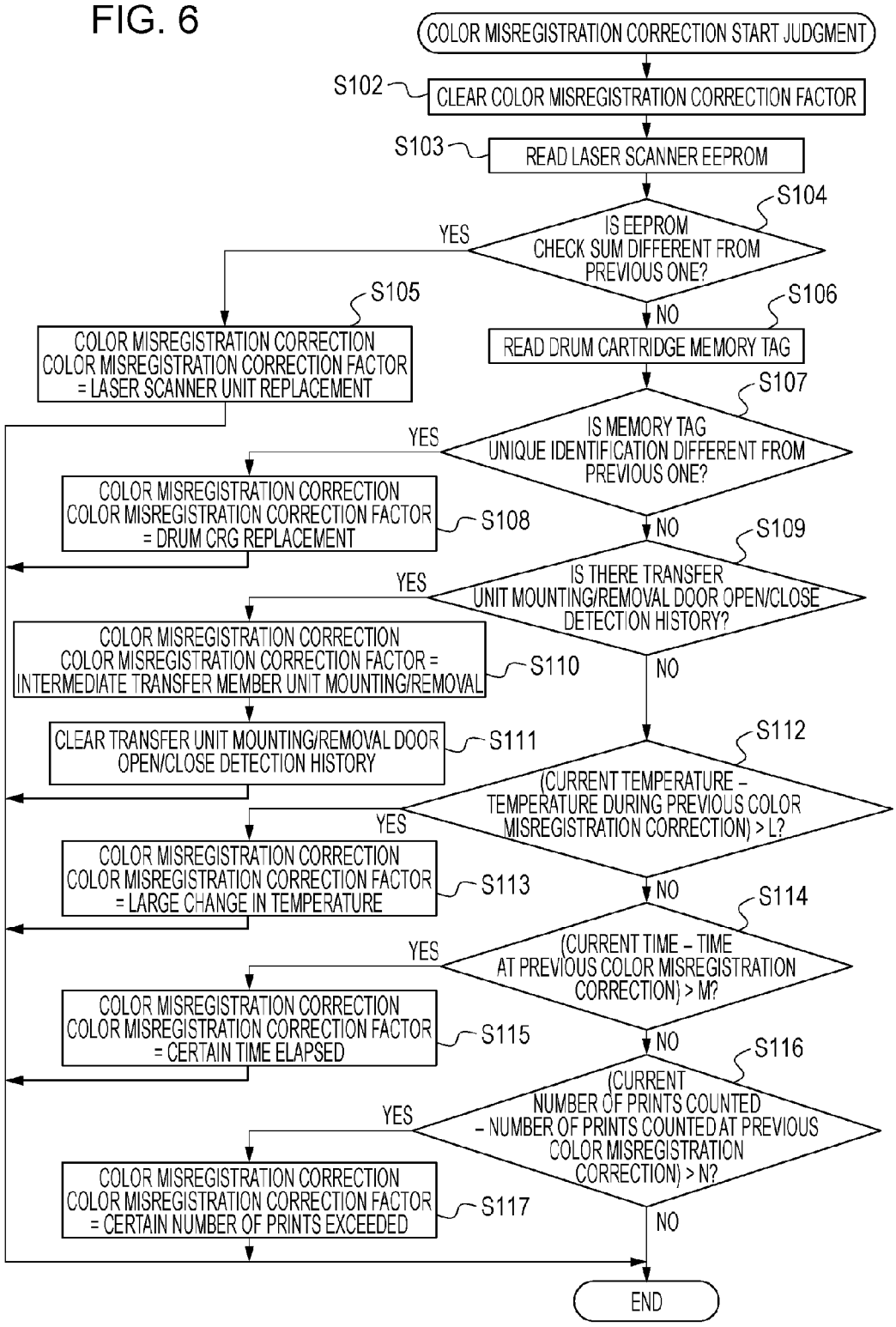
FIG. 6 is a flowchart of a process for judging a condition under which color misregistration correction is begun.

FIG. 6 is a flowchart of a process for judging a condition under which color misregistration correction is begun. The process illustrated in FIG. 6 is executed each time when the power is turned on, when the door is opened or closed, when a print job is begun or terminated, or when 200 sheets have been printed during the print job. First, the CPU 201 clears color misregistration correction factor information (S102) and reads the EEPROM 213 of a laser scanner unit 104 (S103). The CPU 201 then judges whether or not the check sum of data in the EEPROM 213 is different from the previous check sum stored in the backup RAM 204 (S104). If it has been judged that the check sum is different, the CPU 201 begins color misregistration correction using "laser scanner unit replacement" as the color misregistration correction factor information (S105). If it has been judged in step S104 that the check sum is not different, the CPU 201 reads a unique identification from a memory tag of a drum cartridge having a photosensitive drum (photosensitive member) (S106) and judges whether or not the unique identification is different from a previous one stored in the backup RAM 204 (S107).

If it has been judged in step S107 that the unique identification is different, the CPU 201 begins color misregistration correction using "drum cartridge replacement" as the color misregistration correction factor information (S108). If it has been judged in step S107 that the unique identification is not different, the CPU 201 refers to a transfer unit mounting/removal door open/close detection history saved in the backup RAM 204 (S109). If it has been found in step S109 that a transfer unit mounting/removal door open/close detection history has been saved, the CPU 201 begins color misregistration correction using "intermediate transfer member unit mounting/removal" as the color misregistration correction factor information (S110) and clears the transfer unit mounting/removal door open/close detection information saved in the backup RAM 204.

If it has been found in step S109 that a transfer unit mounting/removal door open/close detection history is not saved, the CPU 201 judges a difference between a temperature during the previous color misregistration correction and the current temperature (S112). If it has been judged in step S112 that the difference between the temperatures exceeds a certain value L, the CPU 201 begins color misregistration correction using "large change in temperature" as the color misregistration correction factor information (S113). If it has been judged in step S112 that the difference between the temperatures is the certain value L or less, the CPU 201 judges whether or not a period of time that has elapsed since the previous color misregistration correction exceeds a certain period of time M (S114). If it has been judged in step S114 that the certain period of time M has elapsed, the CPU 201 begins color misregistration correction using "certain time elapsed" as the color misregistration correction factor information (S115). If it has been judged in step S114 that the certain period of time M has not elapsed, the CPU 201 judges whether or not a difference between the number of prints counted in the previous color misregistration correction and the current number of prints counted exceeds a certain number of prints (certain number of pages) N (S116). In this embodiment, N is 200. If it has been judged in step S116 that the certain number of prints N has been exceeded, the CPU 201 begins color misregistration correction using "certain number of prints exceeded" as the color misregistration correction factor information (S117).

If it has been judged in step S116 that the certain number of prints N has not been exceeded, that is, if no condition applies, the CPU 201 does not begin color misregistration correction. Thus, if any of a plurality of conditions is satisfied, a process for detecting the amount of color misregistration and correcting the color misregistration is begun. The CPU 201 stores the color misregistration correction factor information in the RAM 203.

FIG. 7 is a diagram illustrating color misregistration correction tolerances for each color misregistration correction factor. The color misregistration correction tolerances illustrated in FIG. 7 are represented by the numbers of pixels and stored in the ROM 202 as table information for each color misregistration correction factor. The amount of color misregistration that can be caused varies depending on the color misregistration correction factors. A case (701) in which images have been formed on the certain number of pages and a case (702) in which the certain period of time has elapsed, which are first conditions, can be factors in causing color misregistration, but the amount of color misregistration in terms of a main scanning position, a sub-scanning position, the magnification, and the angle of inclination is small. That is, if a large amount of color misregistration is detected after the certain number of prints has been obtained or after the certain period of time has elapsed, it is highly probable that a color misregistration detection pattern has been incorrectly detected. Therefore, the color misregistration correction tolerances are set to be smaller than in other cases.

In addition, in a case (703) in which a change in temperature is large, the probability that a large amount of color misregistration is caused is low except for during first several minutes after the activation, which significantly changes the temperature inside the image forming apparatus. For this reason, if a large amount of color misregistration is detected when a change in temperature has been large, it is highly probable that a color misregistration detection pattern has been incorrectly detected. Therefore, the color misregistration correction tolerance is set to be relatively small.

On the other hand, in a case (704) in which a laser scanner unit has been replaced, it is highly probable that a large amount of color misregistration is caused in terms of the main scanning position, the sub-scanning position, the magnification, and the angle of inclination because a frame of the laser scanner unit, the individual variability of a lens, and the mounting accuracy in terms of the main scanning position, the sub-scanning position, the magnification, and the angle of inclination may significantly affect the amount of color misregistration. Therefore, the color misregistration correction tolerance when a laser scanner unit has been replaced is set to be relatively large in order to perform color misregistration correction even if a large amount of color misregistration is detected. In addition, in a case (705) in which a drum cartridge has been replaced, too, it is highly probable that a large amount of color misregistration is caused in terms of the sub-scanning position and the angle of inclination because the mounting accuracy in terms of the sub-scanning direction and the angle may significantly affect the amount of color misregistration. Therefore, the color misregistration correction tolerance when a drum cartridge has been replaced is set to be relatively large in order to perform color misregistration correction even if a large amount of color misregistration is detected.

Furthermore, in a case (706) in which a transfer unit including the intermediate transfer member 108 has been removed and mounted, it is highly probable that a large amount of color misregistration is caused in terms of the main scanning position because the mounting accuracy in terms of the main scanning direction may significantly affect the amount of color misregistration. Therefore, the color misregistration correction tolerance when a transfer unit has been removed and mounted is set to be relatively large in order to perform color misregistration correction even if a large amount of color misregistration is detected. The color misregistration correction tolerances according to second conditions, whose color misregistration correction factors are replacement of units, are larger than those according to the above-described first conditions.

Figure 8:
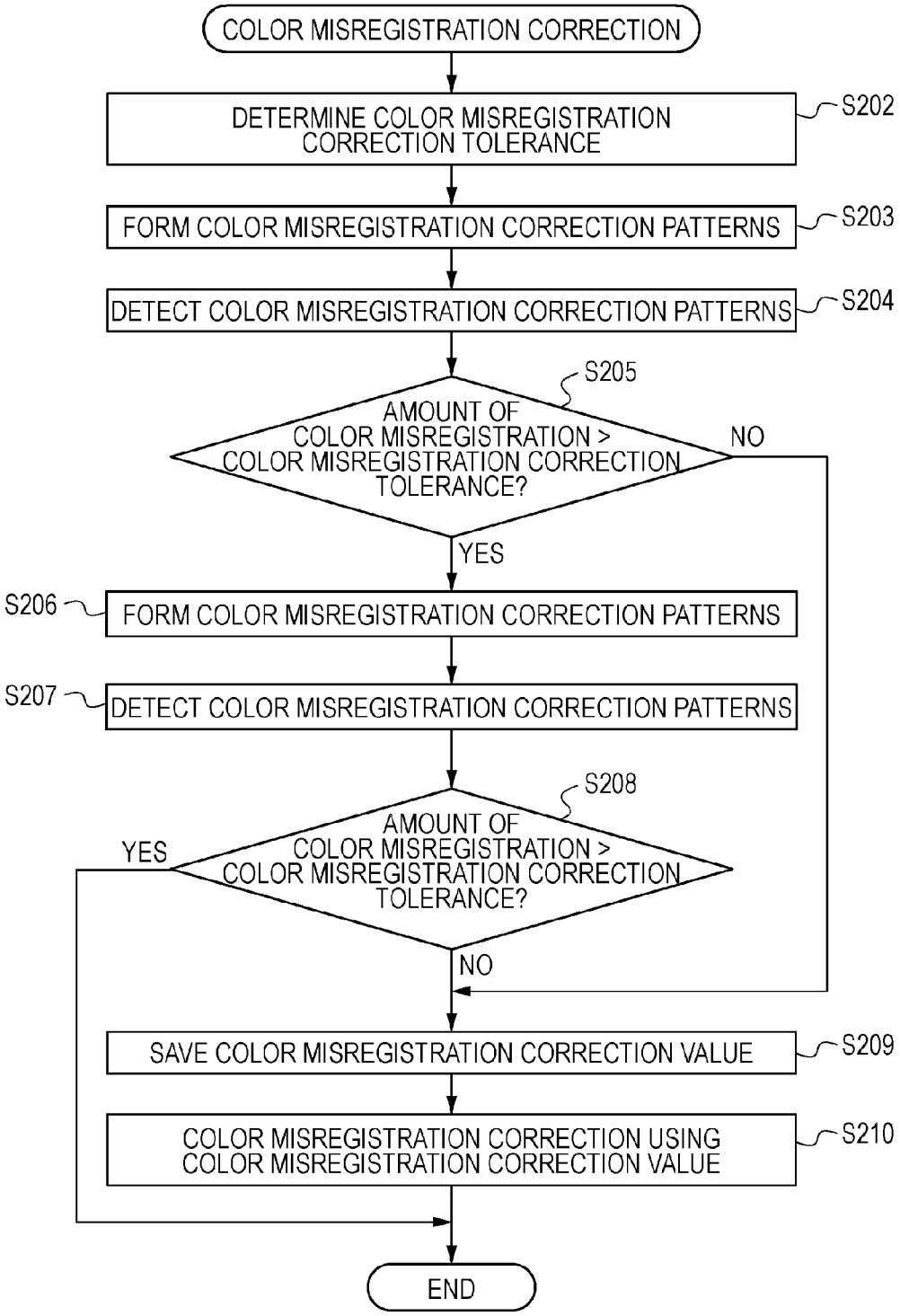
FIG. 8 is a flowchart of a color misregistration correction process using a color misregistration correction tolerance.

FIG. 8 is a flowchart of a color misregistration correction process using a color misregistration correction tolerance. First, the CPU 201 reads color misregistration correction factor information determined by the flow illustrated in FIG. 6 from the RAM 203 and refers to the table information illustrated in FIG. 7 that is stored in the ROM 202, in order to determine a color misregistration correction tolerance corresponding to the color misregistration correction factor information (S202). Next, the CPU 201 causes color misregistration correction patterns to be formed on the intermediate transfer member 108 (S203), and performs color misregistration pattern detection using the pattern detection sensor 112 (S204). The CPU 201 then judges whether or not the detected amount of color misregistration obtained from results of the color misregistration pattern detection exceeds the color misregistration correction tolerance (S205). If it has been judged that the color misregistration correction tolerance is exceeded, the CPU 201 causes color misregistration correction patterns to be formed on the intermediate transfer member 108 again (S206), and performs color misregistration pattern detection using the pattern detection sensor 112 (S207). The CPU 201 then judges whether or not the detected amount of color misregistration obtained from results of the color misregistration pattern detection exceeds the color misregistration correction tolerance (S208).

If it has been judged in step S205 or S208 that the detected amount of color misregistration is equal to or smaller than the color misregistration correction tolerance, the CPU 201 saves the detected amount of color misregistration to the backup RAM 204 as a color misregistration correction value (S209) and performs color misregistration correction using the color misregistration correction value (the color misregistration correction value is fed back to form an image) (S210). If it has been judged in step S208 that the detected amount of color misregistration exceeds the color misregistration correction tolerance, the process is terminated without performing color misregistration correction using the detected amount of color misregistration since it is highly probable that a color misregistration detection pattern has been incorrectly detected. In the color misregistration correction using the detected amount of color misregistration, color misregistration correction for the main scanning position and the sub-scanning position is performed by correcting the image writing timing in accordance with the color misregistration correction value and color misregistration correction for the magnification and the inclination is performed by changing the size of an image and rotating the image through image processing in accordance with the color misregistration correction value.

As described above, a positional deviation of images formed by a plurality of image forming units is corrected in accordance with the amount of color misregistration that is equal to or smaller than a color misregistration correction tolerance, which varies depending on a plurality of conditions, and that has been detected using the color misregistration detection patterns. If the amount of color misregistration detected using the color misregistration detection patterns exceeds the color misregistration correction tolerance corresponding to a condition, the amount of color misregistration detected using the color misregistration detection patterns is not used. Thus, by determining the color misregistration correction tolerance in accordance with the color misregistration correction factor, it is possible to suppress incorrect detection and incorrect correction due to a defect on an intermediate transfer member (image bearing member), a change in the speed of the intermediate transfer member, or the like. Therefore, it is possible to effectively correct color misregistration that can be caused by replacement of a unit.

It is to be noted that although an image on a photosensitive drum is transferred onto a sheet through an intermediate transfer member in the above embodiment, an image forming apparatus that directly transfers an image on a photosensitive drum onto a sheet (image bearing member) is also possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A method for controlling an image forming apparatus including a correction unit for correcting positions of images, formed by a plurality of image forming units, based on a misregistration correction condition, the method comprising the steps of:

forming pattern images in several colors on a plurality of photosensitive members;

transferring the pattern images onto an image bearing member;

detecting an amount of misregistration of the pattern images transferred onto the image bearing member;

saving a misregistration correction condition based on the detected amount of misregistration; and determining whether to form the pattern images based on a predetermined condition, the predetermined condition including a first condition and a second condition, wherein, in a case where it is determined to form the pattern images based on the first condition, the misregistration correction condition based on the detected amount of misregistration is not saved when the detected amount of misregistration is larger than a first tolerance, and in a case where it is determined to form the pattern images based on the second condition, the misregistration correction condition based on the detected amount of misregistration is not saved when the detected amount of misregistration is larger than a second tolerance different from the first tolerance.

2. An image forming apparatus comprising:

a plurality of image forming units configured to form images in a plurality of colors on a plurality of photosensitive members;

an image bearing member onto which the pattern images on the plurality of photosensitive members are transferred;

a correction unit configured to correct the positions of the images, formed by the plurality of image forming units, in accordance with a misregistration correction condition;

a detection unit configured to detect an amount of misregistration of pattern images on the image bearing member;

a storing unit configured to store a misregistration correction condition based on the detected amount of misregistration; and a control unit configured to, if any of a plurality of conditions is satisfied, cause the plurality of image forming units to form the pattern images in the plurality of colors, wherein, if the detected amount of misregistration is smaller than a tolerance corresponding to a satisfied condition, the storing unit stores the misregistration correction condition based on the detected amount of misregistration, wherein, if the detected amount of misregistration is larger than the tolerance corresponding to the satisfied condition, the storing unit does not store the misregistration correction condition based on the detected amount of misregistration, and wherein the plurality of conditions includes first and second conditions, and the tolerance includes a first tolerance corresponding to the first condition and a second tolerance, which is different from the first tolerance, corresponding to the second condition.

3. The image forming apparatus according to claim 2, wherein the plurality of image forming units form images in different colors.

4. The image forming apparatus according to claim 2, wherein the first condition is that the plurality of image forming units have formed images on a certain number of pages after the detection unit detected the amount of misregistration or that a certain period of time has elapsed since the detection unit detected the amount of misregistration.

5. The image forming apparatus according to claim 4, wherein the plurality of image forming units each have a photosensitive member, wherein the second condition is that the photosensitive member has been replaced, and wherein the second tolerance corresponding to the second condition is larger than the first tolerance corresponding to the first condition.

6. The image forming apparatus according to claim 4, wherein the second condition is that the image bearing member has been replaced, and wherein the second tolerance corresponding to the second condition is larger than the first tolerance corresponding to the first condition.

7. The image forming apparatus according to claim 4, further comprising:

an exposure unit configured to perform exposure scanning according to image data on a photosensitive member included in each of the plurality of image forming units, wherein the second condition is that the exposure unit has been replaced, and wherein the second tolerance corresponding to the second condition is larger than the first tolerance corresponding to the first condition.

* * * * *